US011653761B2

(12) United States Patent
Davison et al.

(10) Patent No.: US 11,653,761 B2
(45) Date of Patent: May 23, 2023

(54) REMOVABLE APPLIANCE DOOR WITH REPEATABLE ALIGNMENT

(71) Applicants: BSH Home Appliances Corporation, Irvine, CA (US); BSH Hausgeräte GmbH, Munich (DE)

(72) Inventors: Daniel Davison, Knoxville, TN (US); Charles Hanna, Knoxville, TN (US); Rose Marie Parker, Caryville, TN (US); James Russell, Knoxville, TN (US); Tanner Justice, Powell, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 41 days.

(21) Appl. No.: 16/541,210

(22) Filed: Aug. 15, 2019

(65) Prior Publication Data

US 2021/0045530 A1 Feb. 18, 2021

(51) Int. Cl.

| | |
|---|---|
| ***A47B 88/00*** | (2017.01) |
| ***F24C 15/02*** | (2006.01) |
| ***A47B 88/944*** | (2017.01) |
| ***A47B 88/95*** | (2017.01) |
| ***A47B 88/956*** | (2017.01) |
| *F24C 15/18* | (2006.01) |

(52) U.S. Cl.

CPC ..... *A47B 88/944* (2017.01); *A47B 88/95* (2017.01); *A47B 88/956* (2017.01); *F24C 15/02* (2013.01); *F24C 15/028* (2013.01); *F24C 15/18* (2013.01)

(58) Field of Classification Search

CPC ..... A47B 88/944; A47B 88/95; A47B 88/956; E06B 3/70; F24C 15/18; F24C 15/028; F24C 15/02

See application file for complete search history.

(56) References Cited

U.S. PATENT DOCUMENTS

| | | | | | |
|---|---|---|---|---|---|
| 3,024,075 | A * | 3/1962 | Howe | A47B 88/944 | 312/348.4 |
| 3,895,733 | A * | 7/1975 | Chambers | A47B 88/95 | 220/4.01 |
| 3,933,402 | A * | 1/1976 | Peterson | A47B 88/906 | 312/265.1 |
| 5,144,721 | A * | 9/1992 | Schade | E05D 5/065 | 16/237 |
| 5,161,870 | A * | 11/1992 | Mason | A47B 88/90 | 312/348.4 |

(Continued)

FOREIGN PATENT DOCUMENTS

| | | | | |
|---|---|---|---|---|
| EP | 2225972 A1 | * | 9/2010 | A47B 88/0055 |
| KR | 2003008502 | * | 12/2021 | |

*Primary Examiner* — Kimberley S Wright

(74) *Attorney, Agent, or Firm* — Michael E. Tschupp; Andre Pallapies; Brandon G. Braun

(57) ABSTRACT

A domestic appliance has a width in a horizontal direction and a height in a vertical direction. The appliance includes a main housing; and a first door attached to the main housing. The first door has a rear portion, the rear portion being positionally fixed in the horizontal direction relative to the housing, a door retainer attachable to the rear portion such that the door retainer is locatable at a plurality of different positions relative to the rear portion, and a door skin, the door skin being removably attached to the door retainer.

11 Claims, 5 Drawing Sheets

(56) References Cited

U.S. PATENT DOCUMENTS 5,921,648 A * 7/1999 Rong ..... A47B 95/02 312/265.6
5,951,133 A * 9/1999 Dittberner ..... A47B 88/944 312/348.4
6,048,788 A 4/2000 Huang et al.
6,166,353 A * 12/2000 Senneville ..... F24C 15/08 312/270.3
6,390,576 B1 * 5/2002 Walburn ..... A47B 88/956 312/348.1
6,948,788 B1 * 9/2005 Tai ..... A47B 88/956 312/204
7,469,979 B2 * 12/2008 Tupper ..... E05B 65/462 312/330.1
7,619,182 B2 * 11/2009 Morrow ..... A47B 77/08 219/409
8,916,801 B2 * 12/2014 Harward ..... H05B 3/265 219/385
8,916,802 B2 * 12/2014 Bringe ..... F24C 15/36 219/541
9,265,344 B2 * 2/2016 Chen ..... A47B 96/07
9,347,671 B2 * 5/2016 Bringe ..... F24C 15/105
10,794,627 B2 * 10/2020 Olvera ..... F25D 25/025
2002/0125384 A1 * 9/2002 Compagnucci ..... A47B 96/06 248/200
2003/0111943 A1 * 6/2003 Banicevic ..... A47B 88/944 312/404
2003/0222547 A1 * 12/2003 Trees ..... A47B 88/95 312/204
2005/0093407 A1 * 5/2005 Feeley ..... A47B 88/956 312/348.4
2006/0278629 A1 * 12/2006 Gagas ..... H05B 6/6408 236/1 C
2008/0074019 A1 * 3/2008 Park ..... A47B 88/956 312/236
2008/0129173 A1 6/2008 Freeberg et al.
2009/0153006 A1 * 6/2009 Hazzard ..... A47B 88/95 312/348.4
2010/0007249 A1 * 1/2010 Brown ..... A47B 88/956 312/109
2011/0095667 A1 4/2011 Toland
2013/0318874 A1 * 12/2013 DeLozier ..... E06B 5/00 49/260
2013/0319398 A1 * 12/2013 Braden ..... F24C 15/04 126/200
2013/0319994 A1 * 12/2013 Bringe ..... F24C 15/18 219/391
2013/0319995 A1 * 12/2013 Bringe ..... F24C 15/105 219/399
2015/0320211 A1 * 11/2015 Chen ..... A47B 96/07 312/348.4

* cited by examiner

REMOVABLE APPLIANCE DOOR WITH REPEATABLE ALIGNMENT

FIELD OF THE INVENTION

The invention is directed to a domestic cooking appliance. More particularly, embodiments of the invention are directed to an appliance having a door that is removable and has an alignment feature that provides repeatable alignment when the door is removed and reattached.

An example of an application for the invention is a domestic kitchen oven having a warming drawer with a removable door skin.

BACKGROUND OF THE INVENTION

Some modern domestic kitchens include appliances such as, for example, ovens and ranges that have one or more doors and/or drawers for heating compartments, warming drawers, etc. The door skins of each of these doors/drawers preferably are aligned with each other to give a high-quality appearance to the appliance.

Applicants recognized an improvement to the above arrangement and implement that improvement in embodiments of the invention.

SUMMARY

The invention achieves the benefit of providing an attachment mechanism for easily attaching a door skin to, for example, a drawer so that proper alignment of the door skin with other portions of the appliance can be achieved. A door skin of, for example, a warming drawer may need to be removed for shipping of the appliance to its installation site for various reasons. For example, an appliance with a door skin in place may be too large to fit through a standard residential doorway due to, for example, the handle that is part of the door skin. In this case, the door skin may be removed from a rear portion of the drawer prior to shipping to provide an appliance that can fit through a standard residential doorway. This can present a problem for the installer of the appliance because it may be difficult for them to adjust the door skin so as to align the door skin with other portions of the appliance (other door skins, for example).

Embodiments of the invention address this problem by providing an attachment mechanism for attaching the door skin to the rear portion of the drawer where the alignment can be performed and the door skin removed prior to shipping. The door skin can then be easily attached (without requiring any alignment) to the rear portion of the drawer after the appliance is installed, or at least after it has been located in the kitchen.

Particular embodiments of the invention are directed to a domestic appliance having a width in a horizontal direction and a height in a vertical direction. The appliance includes a main housing; and a first door attached to the main housing. The first door has a rear portion, the rear portion being positionally fixed in the horizontal direction relative to the housing, a door retainer attachable to the rear portion such that the door retainer is locatable at a plurality of different positions relative to the rear portion, and a door skin, the door skin being removably attached to the door retainer.

In some embodiments, the door skin is attachable to the door retainer such that the door skin is locatable in only one position in the horizontal direction relative to the door retainer.

Other embodiments of the invention are directed to a drawer for a domestic appliance, the domestic appliance having a main housing. The drawer includes a compartment portion, the compartment portion being configured to slidably attach to the main housing of the domestic appliance; a door retainer plate attachable to the compartment portion such that the door retainer plate is locatable at a plurality of different positions relative to the compartment portion; and a door skin, the door skin being removably attached to the door retainer plate. The door skin is attachable to the door retainer plate such that the door skin is locatable in only one position relative to the door retainer plate.

In some embodiments the door skin is removable from the door retainer plate while maintaining a position of the door retainer plate relative to the rear portion.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide an improvement to a domestic oven or other appliance.

Figure 1:
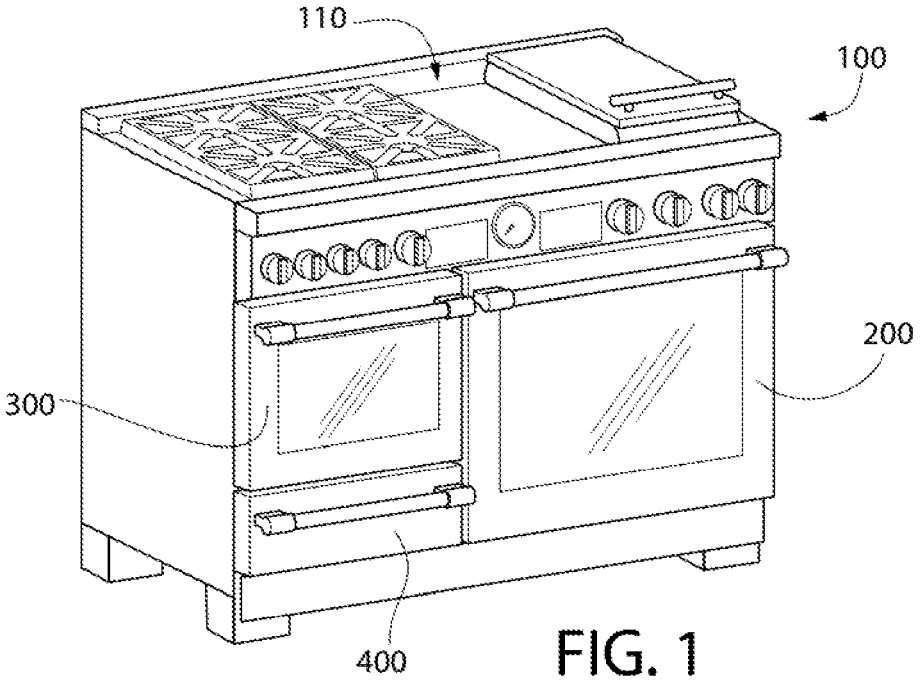
FIG. 1 is a front perspective view of an exemplary appliance in accordance with embodiments of the invention.
Figure 2:
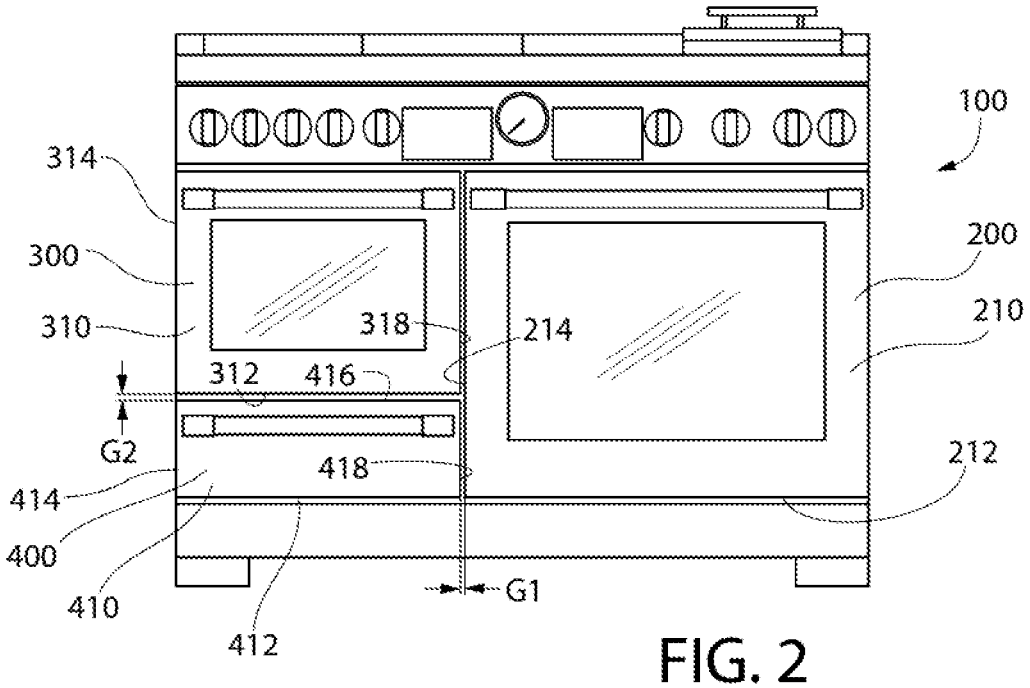
FIG. 2 is a front view of the appliance shown in FIG. 1.

FIGS. 1 and 2 show an example of an appliance 100 in accordance with embodiments of the invention. In this example, appliance 100 has a cook top 110 located on an upper portion of appliance 100. In this example, appliance 100 has three heating compartments including a main oven 200, a secondary oven 300, and a warming drawer 400. Other examples have a different number and/or configuration of heating compartments and/or other compartments. Each of main oven 200, secondary oven 300, and warming drawer 400 has a door skin that is, in this example, the outermost portion of the respective door/drawer. The door skins are often finely finished for an esthetically pleasing overall presentation of appliance 100.

Main oven 200 has a door skin 210 that has a bottom edge 212, and a left side edge 214. Secondary oven 300 has a bottom edge 312, a left side edge 314, and a right side edge 318. Warming drawer 400 has a bottom edge 412, a left side edge 414, a top edge 416, and a right side edge 418. A gap G1 between right side edge 418 of warming drawer 400 and left side edge 214 of main oven 200 is shown in FIG. 2. A gap G2 between top edge 416 of warming drawer 400 and bottom edge 312 of secondary oven 300 is shown in FIG. 2.

As stated above, a door skin of a door or drawer may need to be removed for shipping of the appliance to its installation site for various reasons. The alignment of the door skin is adjustable on many appliances so that, for example, gaps G1 and G2 can be set such that they are the same width and/or various edges of the door skins align with various edges of other door skins and/or sides of the appliance. In the example shown in FIG. 2, it would be desirable for left side edges 314, 414 of warming drawer 300 and secondary oven 400 to align with the left side of appliance 100. In order to achieve this, one or both of door skins 310, 410 may need to be adjusted in the horizontal direction. While this adjustment can be relatively simple for a trained technician in an assembly plant, an installer or a homeowner may find this adjustment difficult and/or tedious. In cases where a door skin must be removed in order for the appliance to fit through a door way or other passage during installation, a simple and easily repeatable alignment of the door skin is desirable.

Embodiments of the invention address this problem by providing an attachment mechanism for attaching the door skin to the rear portion of the drawer where the alignment can be performed and the door skin removed prior to shipping. The door skin can then be easily attached (without requiring any alignment) to the rear portion of the drawer after the appliance is installed, or at least after it has been located in the kitchen or other ultimate location.

Figure 3:
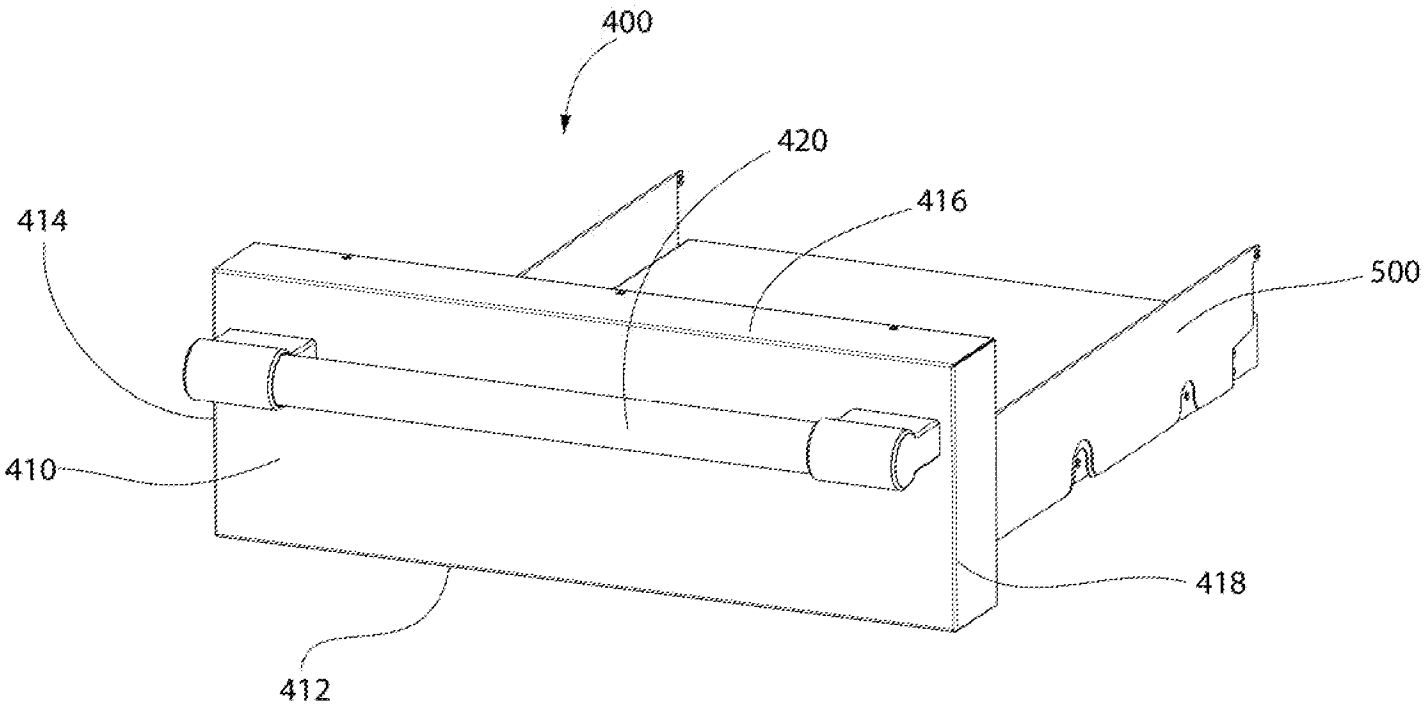
FIG. 3 is a front perspective view of an exemplary drawer in accordance with embodiments of the invention.

FIG. 3 is a perspective view of warming drawer 400 in accordance with embodiments of the invention. While embodiments of the invention will be described with reference to warming drawer 400 that slides in and out relative to a main housing of appliance 100, it is noted that embodiments of the invention also include other sliding drawers, other types of drawers, doors of all types such as, for example, pivoting doors, and any other type of opening closure that requires alignment. For example, door skin 210 of main oven 200 is, in this example, part of a door that pivots around a horizontal axis from a closed position to an open position. Door skin 210 may need to be adjusted in, for example, a horizontal direction in order for a right edge of door skin 210 to align with a right side of appliance 100, and/or to provide a desired width of gap G1. In some examples, all three of warming drawer 400, secondary oven 300, and main over 200 include embodiments of the invention to provide alignment of their respective door skins relative to the main housing of appliance 100.

In the example shown in FIG. 3, warming drawer door skin 410 has attached to it a handle 420. Extending rearward from door skin 410 is a rear portion 500. In this example rear portion 500 is a compartment portion that supports food items to be warmed and/or supports an insert that supports food items to be warmed.

Figure 4:
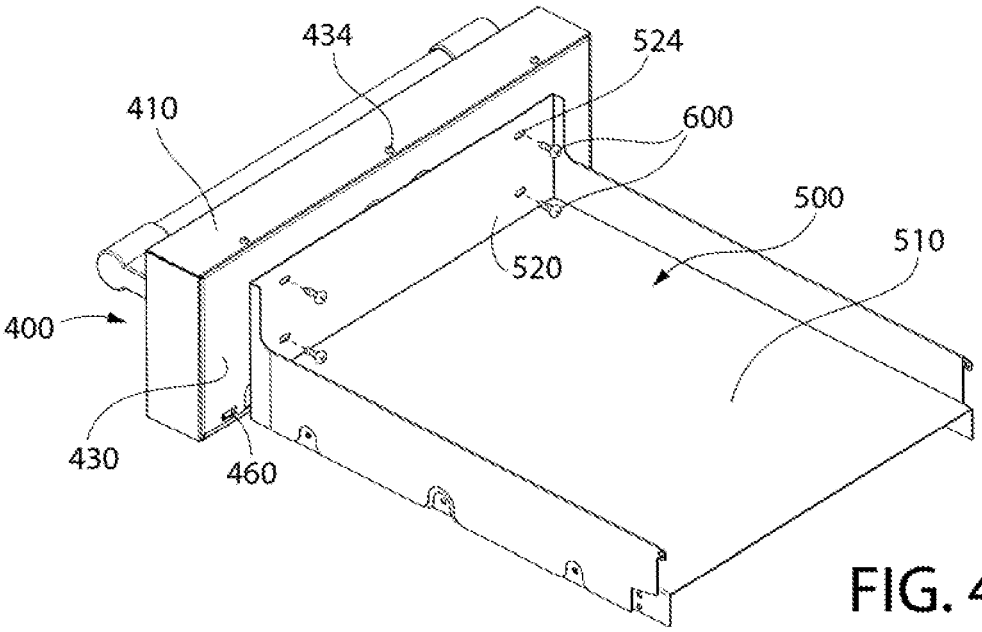
FIG. 4 is a rear perspective view of the drawer shown in FIG. 3.

FIG. 4 is a rear perspective view of warming drawer 400 showing rear portion 500 in more detail. In this example, rear portion 500 has a support area 510 that supports food items to be warmed and/or supports an insert that supports food items to be warmed. Rear portion 500 has an attachment portion 520 that, in this example, has four openings 524 through which fasteners 600 pass to attach rear portion 500 to a door retainer 430. Although four openings 524 and four fasteners 600 are shown in this example, other numbers of openings and fasteners can be used.

As shown in FIG. 4, openings 524 are, in this example, elongated slots that allow lateral adjustment of rear portion 500 relative to door retainer 430 (discussed in more detail below). While slots 524 are used for lateral adjustment in this example, it is noted that other adjustable attachment methods can be used to provide lateral (or other) adjustment of rear portion 500 relative to door retainer 430.

Figure 5:
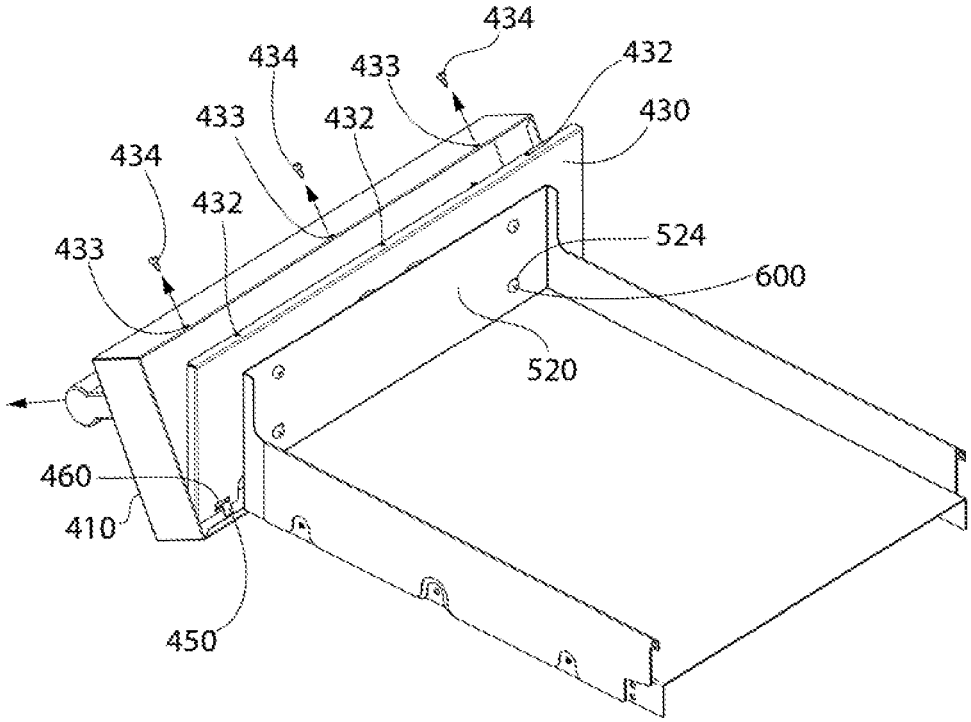
FIG. 5 is a rear perspective view of the drawer shown in FIG. 3 with the door skin in a partially removed state.

FIG. 5 shows door skin 410 partially separated from door retainer 430 while door retainer 430 is attached to rear portion 500. A lower edge of door retainer 430 is attached to door skin 410 by way, in this example, of four tabs 450 that engage four lances 460. Tabs 450 are extensions from a lower edge of door skin 410 (best shown in FIG. 6). Lances 460 are pieces of door retainer 430 that are formed by cutting door retainer 430 and pressing the cut parts inward to form areas that receive tabs 450 (best shown in FIG. 9). In other embodiments, door retainer 430 has tabs 450 and door skin 410 has lances 460. In some embodiments, tabs 450 include holes As shown in FIGS. 4 and 5, a number of screws 434 are used to attach an upper edge of door skin 410 to an upper edge of door retainer 430 by way of holes 433 and 432. Door retainer 430 is shown in a use position in FIG. 4. Door retainer 430 is shown in an a partially installed position in FIG. 5.

Figure 6:
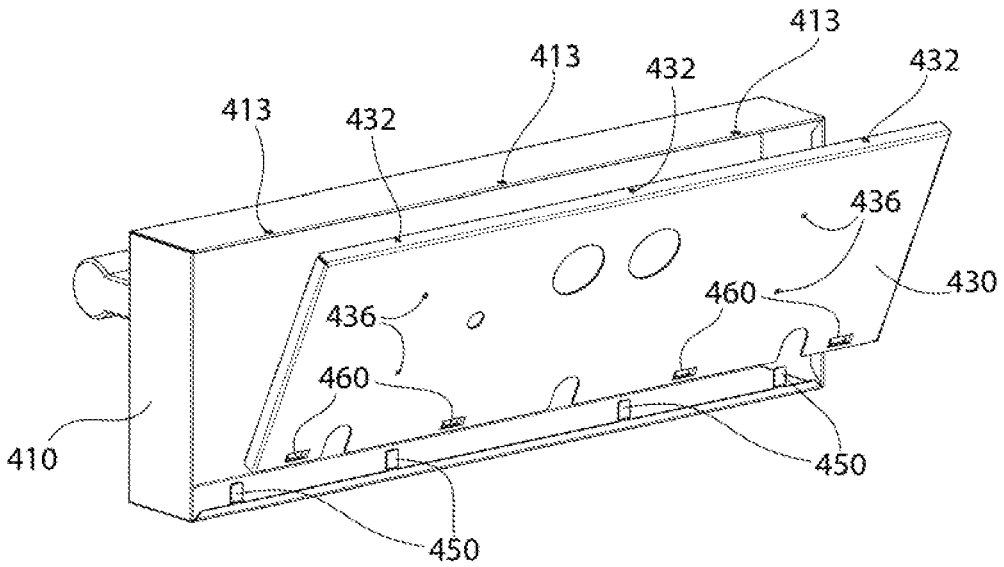
FIG. 6 is a rear perspective view of the door portion of the drawer shown in FIG. 3 with the door skin in a partially removed state.

An example of use of the embodiment shown in the figures is as follows. In the assembly plant, door skin 410 is attached to door retainer 430 by lowering lances 460 of door retainer 430 over tabs 450 of door skin 410. In this example, tabs 450 can be bent without breaking so that door retainer 430 comes into contact with door skin 410 at an angle (as shown in FIG. 6). Once tabs 450 are sufficiently inserted into lances 460, door retainer 430 is pivoted so that the upper edge of door retainer 430 fits inside door skin 410 (as shown in FIG. 4). Screws 434 are then used to secure door skin 410 to door retainer 430. At this point in the assembly, door skin 410 and door retainer 430 are secured to each other such that neither can move relative to the other. Next, the assembly that includes door skin 410 and door retainer 430 is attached to rear portion 500. To properly align door skin 410 with the relevant portions of appliance 100, rear portion 500 is placed in the main housing of appliance 100 such that rear portion 500 is in an operating, or use, position. The technician then attaches door retainer 430 to attachment portion 520 of rear portion 500 using screws 600 through slots 524. The technician can move door skin 410 (and thus door retainer 430) laterally relative to rear portion 500 as screws 600 move laterally within slots 524 until proper alignment is achieved. Once proper alignment is achieved, screws 600 are tightened to secure rear portion 500 to door retainer 430. At this point warmer drawer 400 is properly aligned and installed in appliance 100.

For shipping, door skin 410 is removed from door retainer 430 by removing screws 434, tilting the upper edge of door skin 410 away from the upper edge of door retainer 430 (as shown in FIG. 5), and pushing door skin 410 downward so that tabs 450 disengage with lances 460. At this point, door skin 410 is separated from door retainer 430 while door retainer 430 is still attached to rear portion 500. By leaving door retainer 430 attached to attachment portion 520 of rear portion 500, the alignment of the assembly is not altered. As a result, when door skin 410 is reattached to door retainer 430, door skin 410 will still be properly aligned relative to the main housing of appliance 100.

Figure 7:
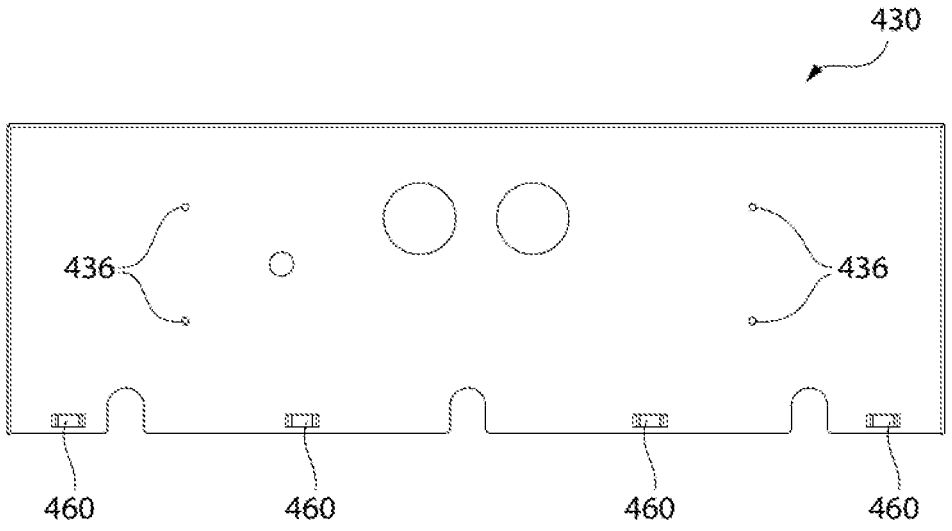
FIG. 7 is a rear view of a portion of the door shown in FIG. 6.

FIG. 7 shows door retainer 430 in more detail and separate from door skin 410 and rear portion 500. While screws are used as fasteners in this example, other fasteners can be used to attached door skin 410 to door retainer 430 and to attached door retainer 430 to rear portion 500. For example, other fasteners can include bolts (with captured nuts or other threaded receiving portions), press fasteners, other friction fasteners, or other removable fasteners. In some embodiments, for attaching door retainer 430 to rear portion 500, non-removable/non-reusable fasteners such as rivets or other non-removable/non-reusable fasteners can be used. If non-removable/non-reusable fasteners are used, the alignment established by the technician cannot be accidentally (or otherwise) changed without destroying the fastener.

While particular numbers of fasteners, holes, slots, tabs, and lances are used in the examples shown, it is notes that other numbers of fasteners, holes, slots, tabs, and lances can be used. Also, although tabs and lances are shown as a slidable attachment feature, other slidable attachment features can be used such as, for example, pins and holes or other attachment features. Although screws and holes can be used at the lower edges of door skin 410 and door retainer 430 in some embodiments, it is noted that in some installations there is insufficient room below door skin 410 to use a screw driver or other appropriate tool.

Figure 8:
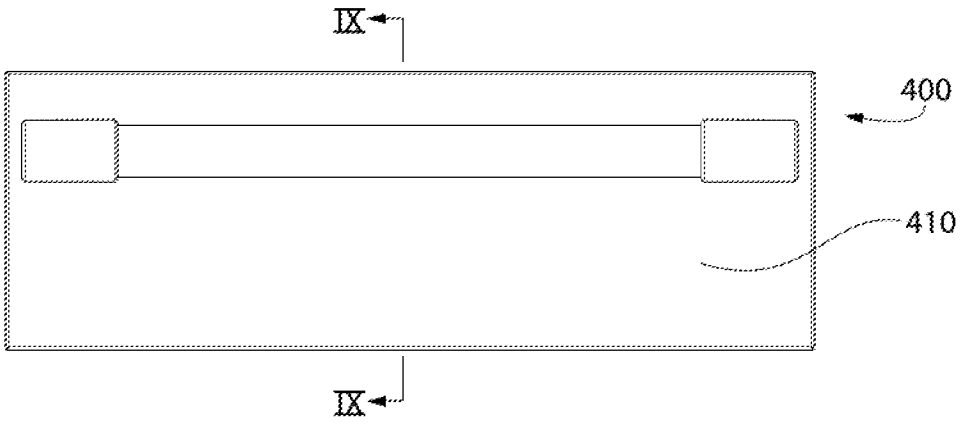
FIG. 8 is a front view of the drawer shown in FIG. 3.
Figure 9:
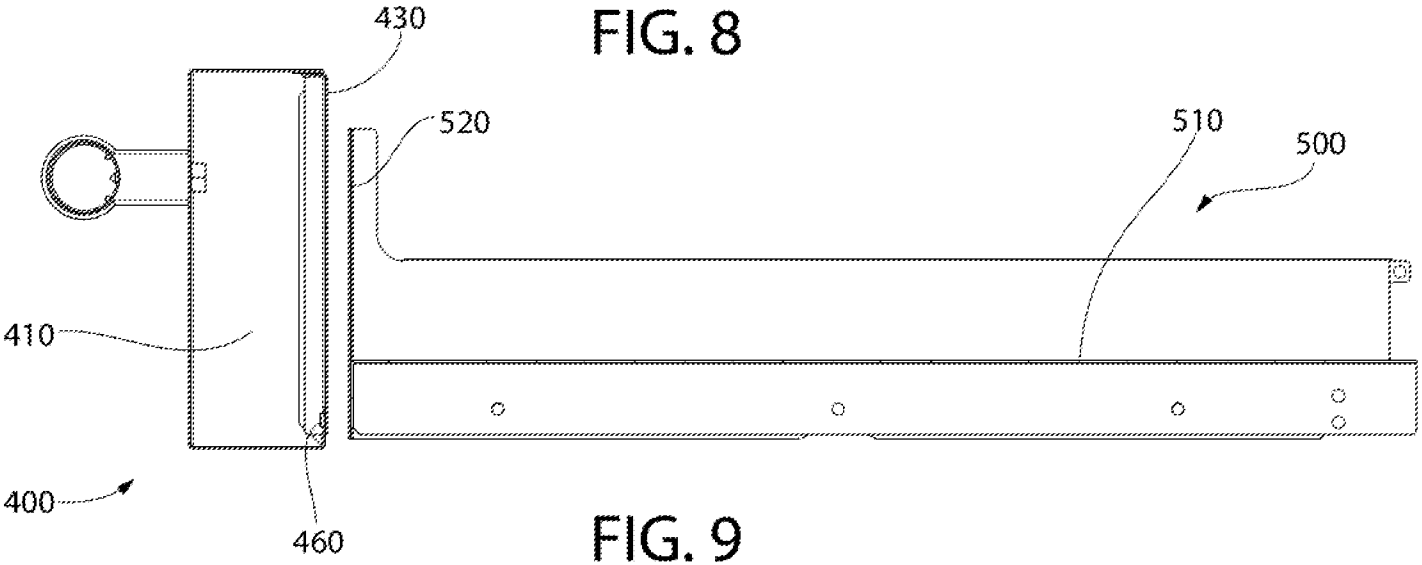
FIG. 9 is a sectional view taken along section line IX-IX in FIG. 8.

FIG. 8 is a front view of warming drawer 400 and FIG. 9 is a sectional view along section line IX-IX in FIG. 8. FIG. 9 shows door skin 410 attached to door retainer 430. The assembly of door skin 410 and door retainer 430 is shown separated from rear portion 500. This is the state in which appliance 100 would be shipped (with the assembly of door skin 410 and door retainer 430 wrapped in protective material and secured in support area 510 of rear portion 500 or in some other area of appliance 100).

While the invention is described above using an example providing lateral adjustment, it is noted that embodiments of the invention provide vertical adjustment, depth adjustment, or any combination of the three. Still other examples provide adjustment in other directions or combinations of directions.

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A domestic appliance having a width in a horizontal direction and a height in a vertical direction, the appliance comprising:
- a main housing; and
- a first door attached to the main housing, the first door including:
  - a rear portion, the rear portion being positionally fixed in the horizontal direction relative to the housing,
  - a door retainer attachable to the rear portion such that the door retainer is locatable at a plurality of different positions relative to the rear portion, and
  - a door skin, the door skin being removably attached to the door retainer such that the door skin is locatable in only one position relative to the door retainer,
  - wherein the door skin is configured to be aligned with the main housing when the door skin is attached to the door retainer by locating the door retainer relative to the rear portion and fixing a position of the door retainer relative to the rear portion with a door retainer attachment feature,
  - wherein the door skin is removably attached to the door retainer with a door skin attachment feature, which is independent from the door retainer attachment feature, such that the door skin is configured to be removable from the door retainer without altering the position of the door retainer relative to the rear portion and such that the door skin remains aligned with the main housing when the door skin is reattached to the door retainer,
  - wherein the door retainer attachment feature includes:
    - an upward facing tab on the door skin;
    - a lance on the door retainer; and
    - a door skin fastener engaging the door skin and the door retainer, and
  - wherein the upward facing tab slidably disengages the lance when the door skin is moved in a downward direction with respect to the door retainer and slidably engages the lance when the door skin is moved in an upward direction with respect to the door retainer.

2. The domestic appliance of claim 1, further comprising a door retainer fastener that attaches the door retainer to the rear portion,
- wherein the rear portion comprises a slot through which a portion of the door retainer fastener passes, and
- the slot allows the door retainer to be positioned at the plurality of different positions.

3. The domestic appliance of claim 1, further comprising a second door, the second door being located above the first door in the vertical direction,
- wherein the first door has a lateral edge,
- the second door has a lateral edge,
- the lateral edge of the first door aligns with the lateral edge of the second door when the door retainer is positioned at a first one of the plurality of different positions, and
- the lateral edge of the first door is misaligned with the lateral edge of the second door when the door retainer is positioned at a second one of the plurality of different positions.

4. The domestic appliance of claim 1, further comprising a door skin fastener that positionally fixes the door skin to the door retainer.

5. The domestic appliance of claim 1, wherein the rear portion is a drawer that slides relative to the main housing.

6. A drawer for a domestic appliance, the domestic appliance having a main housing, the drawer comprising:
- a compartment portion, the compartment portion being configured to slidably attach to the main housing of the domestic appliance;
- a door retainer plate attachable and positionally fixed to the compartment portion by a door retainer attachment feature such that the door retainer plate is locatable at a plurality of different positions relative to the compartment portion; and
- a door skin, the door skin being removably attached to the door retainer plate,
- wherein the door skin is attachable to the door retainer plate such that the door skin is locatable and positionally fixed in only one position relative to the door retainer plate, wherein the door skin is removably attached to the door retainer with a door skin attachment feature, which is independent from the door retainer attachment feature, such that the door skin is removable from the door retainer without altering the position of the door retainer relative to the compartment portion, wherein the door retainer attachment feature includes:

an upward facing tab on the door skin;

a lance on the door retainer; and a door skin fastener engaging the door skin and the door retainer, and wherein the upward facing tab slidably disengages the lance when the door skin is moved in a downward direction with respect to the door retainer and slidably engages the lance when the door skin is moved in an upward direction with respect to the door retainer.

7. The drawer of claim 6, wherein all of the plurality of different positions are arranged along a line.

8. The drawer of claim 6, further comprising a door retainer plate fastener that attaches the door retainer plate to the compartment portion, wherein the compartment portion comprises a slot through which a portion of the door retainer plate fastener passes, and the slot allows the door retainer plate to be positioned at the plurality of different positions.

9. The drawer of claim 8, wherein the door skin comprises a first engagement portion, the door retainer plate comprises a second engagement portion, and the first engagement portion slidably engages the second engagement portion when the door skin is attached to the door retainer plate.

10. The drawer of claim 6, further comprising a door retainer plate fastener that attaches the door retainer plate to the compartment portion, wherein the compartment portion comprises a slot through which a portion of the door retainer plate fastener passes, and the slot allows the door retainer plate to be positioned at the plurality of different positions.

11. The domestic appliance of claim 1, wherein, when the door skin fastener is disengaged from at least one of the door skin and the door retainer, the door skin is pivotable relative to the engaged upward facing tab and lance, and wherein the upward facing tab slidably disengages the lance when the door skin is moved at a downward angle with respect to the door retainer.

* * * * *